United States Patent [19]

Oakley

[11] 4,167,377

[45] Sep. 11, 1979

[54] POWDER ROLLING APPARATUS

[75] Inventor: Samuel T. Oakley, Stourbridge, England

[73] Assignee: The International Nickel Company, Inc., New York, N.Y.

[21] Appl. No.: 926,863

[22] Filed: Jul. 21, 1978

[30] Foreign Application Priority Data

Jul. 29, 1977 [GB] United Kingdom ..... 31986/77
Oct. 3, 1977 [GB] United Kingdom ..... 40998/77

[51] Int. Cl.[2] ..... B22F 3/18
[52] U.S. Cl. ..... 425/79; 425/363
[58] Field of Search ..... 425/363, 79

[56] References Cited

U.S. PATENT DOCUMENTS

| | | | |
|---|---|---|---|
| 2,904,829 | 9/1959 | Heck | 425/79 |
| 3,124,838 | 3/1964 | Lund et al. | 425/79 |
| 3,242,530 | 3/1966 | Hirsch et al. | 425/79 |

*Primary Examiner*—Robert F. White
*Assistant Examiner*—James R. Hall
*Attorney, Agent, or Firm*—Lewis Messulam; Ewan C. MacQueen

[57] ABSTRACT

Powder rolling apparatus, for the production of strip equal in width to the roll length, is provided with edge restraint devices in the form of cylindrical blocks mounted in the roll gap region with their axes parallel to the roll axes and rotatably driven to cause an end-face of each restraint block to move in frictional contact with the end-faces of the rolls.

10 Claims, 2 Drawing Figures

Fig. 1
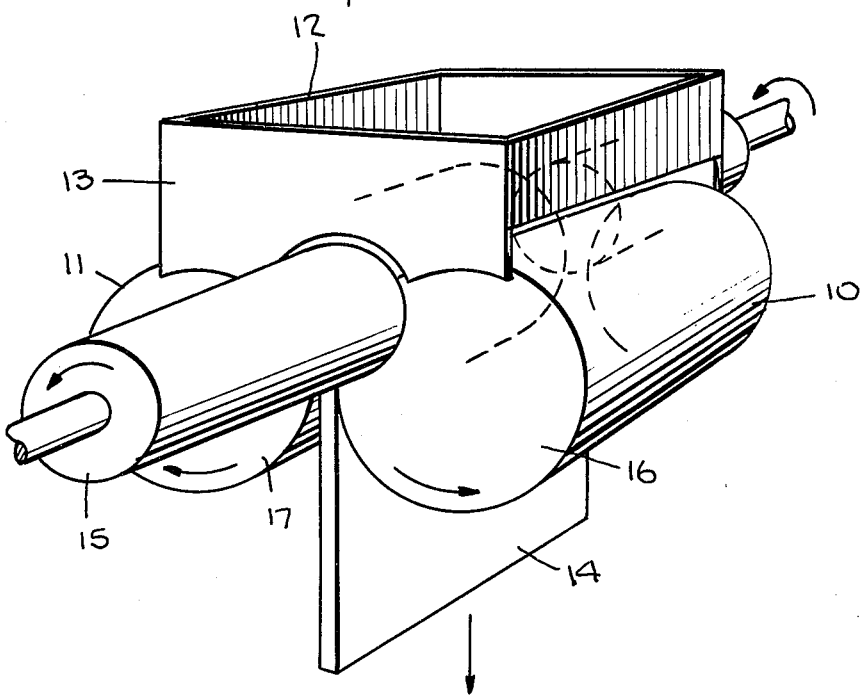
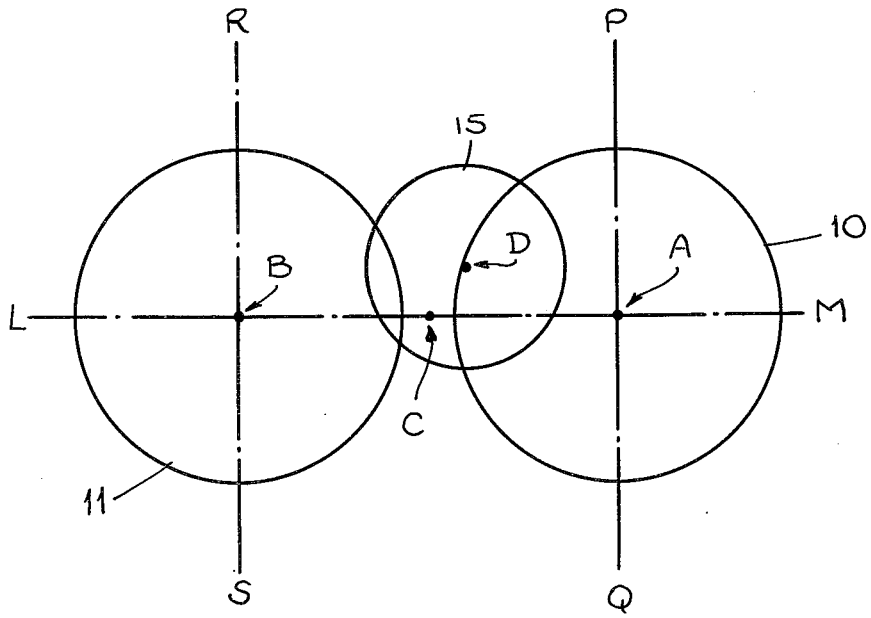
Fig. 2.

POWDER ROLLING APPARATUS

FIELD OF THE INVENTION

The present invention relates to the compaction of metallic powder to strip or sheet form by rolling, and is particularly concerned with improved powder rolling apparatus which is provided with edge restraint means for controlling the lateral spread of powder in the roll gap.

BACKGROUND OF THE INVENTION

As is well known, metal powders (which term is used herein to include powders consisting at least in part of one or more metals and/or alloys) can be compacted by feeding them to the intake side of a gap between a pair of rolls. The powder may be compacted at ambient or elevated temperature, and the strip-like product which issues from the exit side of the roll gap may be flat sided, through contoured rolls may be used to provide any desired surface profile on the product.

In all powder rolling applications, a problem is posed by the tendency of powder to spread laterally in the roll gap, i.e., at right angles to the rolling direction. Such a tendency results in the production of strip having weak, low density edges, so that an edge trimming operation becomes necessary. In large scale operations, particularly of the continuous type, it is highly desirable to be able to avoid or to at least to minimize any edge trimming needed since such trimming is not only a labor intensive operation but also represents wasted energy associated with the large amount of scrap produced thereby. The problem of controlling strip edges is particularly acute where the apparatus is designed to produce a strip extending over the entire length of the roll gap. In such a case the lateral spread of powder results in egress of the powder from the roll gap. It is with the production of such strip, i.e., the width of which is equal to the length of the rolls, that the present invention is particularly concerned.

In the past various methods have been suggested for controlling the edge of a strip produced by powder rolling. One type of edge control involves the use of a stationary restraint member urged against the end-faces of the rolls in the vicinity of the roll gap, thereby acting as a closure for the roll nip area. Alternatively, it has been proposed to provide flange-like constructions which are fixed to one of the rolls or integrally constructed therewith so as to overlap the other roll at the extremity thereof or in a groove provided near the extremity thereof. Further alternatives which have been suggested involve the use of one or more rollers mounted with their axes orthogonal to the roll axes and forced against the end-faces of the rolls, or used to urge a strip of metal or rubber into contact with the roll end-faces. Yet another approach which has been advocated involves feeding an edge-restraint strip into the roll gap at both extremities thereof, with the powder being fed between the strips.

None of the above-mentioned approaches has provided an entirely satisfactory solution to the problem. Typical of their shortcomings are:

I. Whenever the edge-restraint device is a stationary member, a static powder zone results in the roll nip region and the strip produced exhibits edges of low density, or even unconsolidated edges;

II. Many of the designs suggested do not adequately prevent powder egress from the roll gap because they make only a tangential contact with the roll end-faces;

III. Devices which employ a moving surface to restrain the strip edge generally cease to operate effectively when wear of that surface takes place. Such wear is inevitable when contact is made with the end-faces of the rolls since different points on these end-faces move, in operation, with different linear velocities;

IV. In the case of apparatus employing narrow bands or belts which contact the roll edges or which are fed between the rolls, the edge control bands may be easily damaged, or they may beome entrapped in the metal strip produced. Moreover, the use of such bands or belts generally restricts the flexibility of the apparatus for producing strips of different thicknesses.

OBJECT OF THE INVENTION

It is an object of the present invention to provide improved powder rolling apparatus which incorporates simple and reliable edge control devices enabling metallic strip as wide as the roll length to be produced with sound edges which do not require subsequent trimming.

SUMMARY OF THE INVENTION

The present invention provides apparatus for compacting metal powders consisting of a pair of generally cylindrical rolls of equal length mounted for rotation about respective parallel spaced roll axes to define a roll gap therebetween, means for feeding metal powder to an intake side of the roll gap along the entire length of the rolls to be compacted to a strip-like product of width equal to the roll length and edge-restraint means at opposite axial extremities of the rolls effective to prevent powder egress from the roll gap in a direction parallel to the roll axes, wherein each edge-restraint means comprises a restraint member consisting of a cylindrical block of smaller diameter than each roll, rotatably mounted about an axis which is parallel to the roll axes and spaced therefrom, means for urging each restraint member so as to cause portions of an end-face thereof to contact a portion of an end-face of each of the rolls adjacent the intake side of the roll gap, and driving means connected to each restraint member and effective to impart rotation thereto, thereby producing relative sliding motion between the end-face of the restraint member and the respective end-faces of the rolls.

In operation of the apparatus of the invention the restraint member is rotatably driven while its end-face is maintained in frictional contact with the roll end-faces. Gradual wear of the restraint member end-face is of course expected to occur, but throughout such wear the end-face of the member will continue to mate with the roll end-faces, against which it is urged by suitable spring biasing, so as to maintain a powder tight seal at the roll nip.

To avoid damage to the rolls it is preferred to construct the restraint member, or at least the portion thereof which contacts the roll end-faces, of a material which wears in preference to the roll material. Thus for example the restraint member may be made of a steel softer than the steel used for the roller end-faces, or it might be made of material such as brass or even a brake-lining composite material. Most preferably the restraint member can have a two-piece construction comprising a permanent shank with a replaceable wear-tip fixed thereto.

A driving force, other than any force resulting from friction with the rolls, must be provided for rotating the restraint member about its central axis. The driving force can be supplied by a separate motor, or may for convenience be supplied, using suitable mechanical coupling, by the same motor used for driving the rolls.

The restraint member can be positioned in different ways relative to the two roll axes, providing that in all cases the end-face of the restraint member effectively seals off the gap between the rolls at the intake side of the roll gap. Thus the restraint member axis can be anywhere between a pair of planes each containing a roll axis and each perpendicular to the common plane of the roll axes. For example, the restraint member axis can coincide with the line drawn at the roll gap center parallel to and coplanar with the roll axes, which line shall be referred to for convenience as the "roll gap central axis". Preferably however, the restraint member axis is offset from that roll gap central axis. The offset can comprise a displacement parallel to or normal to the common plane of the roll axes. Such an offset is preferred for two reasons. Firstly it can be used to minimize contact between the restraint member and the edge of a compacted strip, which contact is neither necessary nor beneficial. Furthermore, the offset can be used to ensure that the center of the restraint member end-face, which is the only location of that end-face constituting a stationary spot, is removed from the vicinity of the roll gap. Preferably the restraint member is so positioned that it overlaps the first and second rolls to different extents. Most preferably the center of the restraint member end-face lies within the portion of that end-face overlapped by one of the rolls.

Where as is preferred the rolls are overlapped to different extents by the restraint member, it is preferable to rotate the member in the same angular direction as the roll with which there is greater overlap. When this is done the direction of movement of the member's end-face will be generally with the powder flow rather than against it.

In order to maximize the flexibility of the apparatus for coping with different powders and for the production of different strip thicknesses, it is preferable to mount the restraint member in such a manner that its central axis can be selectively moved to various positions spaced from and parallel to the roll gap central axis.

For a clearer understanding of the invention a specific embodiment thereof will now be described by way of example. (It should be understood that although, for the sake of simplicity, reference is made below to a mill employing vertical powder feed, the invention is by no means restricted to such mills and can with equal success be embodied in apparatus wherein powder is fed horizontally to the roll gap.)

BRIEF DESCRIPTION OF THE DRAWINGS

In the accompanying drawings:

FIG. 1 is a schematic illustration of a perspective view of the rolls and edge restraint member in an embodiment of the invention; and FIG. 2 illustrates the position of the restraint member axis relative to the roll axes in the embodiment of FIG. 1.

DETAILED DESCRIPTION OF THE EMBODIMENT

In FIG. 1, a pair of rolls 10 and 11 of equal length and diameter are shown in a horizontally spaced configuration. The rolls have generally flat end-faces and are mounted (by means not illustrated) with their end-faces coplanar with one another. A rechargeable hopper 12 is positioned above the rolls, and has a lower end which is shaped to follow the roll contours so that powder is discharged from a hopper slot above and close to the roll gap. The end-walls 13 of the hopper are shaped and dimensioned so as to overlap the roll edges, and sealing means may be provided to ensure a powder-tight fit between the end walls 13 and the rolls.

Powder fed to the roll gap exits downwards as a compacted strip 14. Edge restraint is provided by a cylindrical block 15 mounted at each axial extremity of the roll gap. The block is urged towards the rolls by means (not illustrated) which may be either automatically or manually adjustable to allow for wear of the block. The urging may be effected by spring-biasing or by means of hydraulic pressure for example. Under the action of the urging means, a frictional contact is maintained between the end-face of the block 15 and the end-faces 16 and 17 of the rolls 10 and 11 respectively. Moreover a powder-tight seal is maintained between the block 15 and the hopper 12 by shaping the end-wall 13 of the hopper so as to conform to the contour of the block 15 and preferably providing seals between the lower edge of the end-wall 13 and the outer cylindrical surface of the block 15.

It is preferable to mount the restraint member 15 so that its position relative to the roll axes is selectively adjustable. To accommodate such variation of the position of the block 15, the end-walls 13 of the hopper should be adaptable to the displacement of the block 15, or movable with the block so that a powder-tight seal can be established at all times therebetween.

A preferred positioning of the restraint member is illustrated in FIG. 2. In that diagram the line L M represents the horizontal plane containing the rotational axes A and B respectively of the rolls 10 and 11. The lines P Q and R S represent vertical planes containing the axes A and B respectively. The point C represents the roll gap central axis, and as can be seen from the drawing the preferred configuration involves positioning the restraint member 15 so that is rotational axis D is displaced both vertically and horizontally from the roll gap central axis C. This results in a much greater extent of overlap between the block 15 and the roll 10, than between the block 15 and the roll 11.

The precise position of the block axis D can of course be otherwise than as illustrated. D can, in general, be positioned anywhere between the planes P Q and R S, providing the arrangement enables the restraint member to seal off adequately the powder intake side of the roll gap (i.e., the portion of the roll gap above and close to the line L M). However, the arrangement illustrated is preferred for the following reasons:

i. By virture of the vertical displacement of D from C there is little or no contact of the restraint member with the compacted strip;

ii. The extent of the horizontal displacement of D from C is such that D lies within that portion of the end-face of block 15 which overlaps the end-face of roll 10. In this way it is possible to avoid even a point contact between the powder and a stationary edge restraint surface; and iii. With such a horizontal displacement the restraint member surface which contacts the powder can be arranged to move in the same general direction as the powder flow. This is achieved by rotating the block 15 in the same angular direction as the roll which is overlapped by the block to a greater extent, i.e., the block 15 and the roll 10 are both driven anti-clockwise as viewed in the drawing.

Rotating cylindrical blocks of the above-described type provide an effective as well as convenient form of edge restraint. They can be used with a wide range of roll gap settings to produce various strip thicknesses. They can be replaced in a relatively simple manner when a predetermined amount of wear has taken place. It has been found convenient to construct each block 15 in two detachable parts: a first cylindrical portion acting as a permanent shank, and a second cylindrical portion constituting a wear tip. Removal of a restraint member from the apparatus will only be necessitated when the block, or the tip thereof in the case of two-part construction, has worn to such an extent that inadequate powder sealing results. The time period between necessary replacement can be controlled by suitable choice of the axial dimension of the wear tip. Thus where the material used is one that will wear very slowly, the wear tip may be a relatively short cylinder, i.e., disc-like in shape.

It is to be understood that the foregoing description of an embodiment of the invention is merely exemplary and many modifications may be made to the details of the embodiment. For example the invention may be embodied in a rolling mill wherein the rolls are vertically superimposed and powder is fed horizontally to the roll gap. Also whereas a powder feed mechanism has been described which incorporates a hopper having end-walls which overlap the roll edges, alternative hopper designs can be used. For example the hopper may be so shaped as to fit between the rolls with its end-walls coplanar with the roll end-faces. In such a case the restraint member may be urged into frictional contact with the hopper end-wall as well as the roll end-faces. Furthermore, the rolls need not be of identical diameter to one another, nor is it essential that their end-faces be entirely flat providing a portion thereof to be contacted by the restraint member is flat. Such variations and others may be made to the embodiment described without departing from the scope of the invention which is defined by the appended claims.

What is claimed is:

1. In apparatus for compacting metal powders comprising a pair of generally cylindrical rolls of equal length mounted for rotation about respective parallel spaced roll axes to define a roll gap therebetween, means for feeding metal powder to an intake side of the roll gap along the entire length of the rolls to be compacted to a strip-like product of width equal to the roll length, and edge-restraint means at opposite axial extremities of the rolls effective to prevent powder egress from the roll gap in a direction parallel to the roll axes, the improvement wherein each edge restraint means comprises a restraint member consisting of a cylindrical block of smaller diameter than each roll, rotatably mounted about an axis which is parallel to the roll axes and spaced therefrom, means for urging each restraint member so as to cause portions of an end-face thereof to contact a portion of an end-face of each of the rolls adjacent the intake side of the roll gap, and driving means connected to each restraint member and effective to impart rotation thereto, thereby producing relative sliding motion between the end-face of the restraint member and the respective end-faces of the rolls.

2. Apparatus as claimed in claim 1, wherein each restraint member is positioned such that its rotational axis is spaced from a line which is drawn through the center of the roll gap and which is parallel to and coplanar with the roll axes.

3. Apparatus as claimed in claim 1, wherein the rolls are of equal diameter and each restraint member is positioned such that the end-face of the restraint member overlaps the end-face of a first one of the rolls to a greater extent than the end-face of the other roll.

4. Apparatus as claimed in claim 3, wherein the portion of each restraint member end-face which overlaps the end-face of the first roll includes the rotational axis of the restraint member.

5. Apparatus as claimed in claim 4, wherein each restraint member is arranged to be driven, in operation, in the same direction as the first roll.

6. Apparatus as claimed in claim 5, wherein the rolls are of equal diameter to one another, and are mounted with their axes in a horizontal plane, each restraint member being mounted with its rotational axis above the horizontal plane of the roll axes.

7. Apparatus as claimed in claim 1, wherein each restraint member is adjustably mounted relative to the rolls so as to enable the rotational axis of the restraint member to be selectively displaced in a direction within or parallel to the plane containing the roll axes.

8. Apparatus as claimed in claim 7, wherein the mounting of the restraint member enables the restraint member to be displaced in a direction normal to the plane containing the roll axes.

9. Apparatus as claimed in claim 1, wherein at least the end-face of each cylindrical block is constructed of a material which is less wear-resistant than the end-face of the rolls.

10. Apparatus as claimed in claim 9, wherein each cylindrical block comprises a cylindrical shank portion and a cylindrical tip portion, the tip portion being detachably fixed to the shank portion and coaxial therewith.

* * * * *